US007981227B1

(12) United States Patent
Smythe

(10) Patent No.: US 7,981,227 B1
(45) Date of Patent: Jul. 19, 2011

(54) FLEX TRIM CONTAINER WITH HANDLES

(76) Inventor: Timothy Smythe, Bend, OR (US)

( * ) Notice: Subject to any disclaimer, the term of this patent is extended or adjusted under 35 U.S.C. 154(b) by 235 days.

(21) Appl. No.: 12/290,111

(22) Filed: Oct. 27, 2008

Related U.S. Application Data

(60) Provisional application No. 61/000,786, filed on Oct. 28, 2007.

(51) Int. Cl.
*E04F 13/02* (2006.01)
*B65D 85/02* (2006.01)

(52) U.S. Cl. ..... 156/71; 206/389; 206/409; 52/746.1

(58) Field of Classification Search ..... 156/71, 156/573, 574, 577–579; 206/389, 409, 411, 206/820; 221/70–74, 197, 198, 282–286; 222/175, 180; 81/487; 248/309.1, 310, 311.2; 52/746.1
See application file for complete search history.

(56) References Cited

U.S. PATENT DOCUMENTS 4,042,168 A * 8/1977 Kasel et al. ..... 206/396
4,417,677 A * 11/1983 Mead ..... 225/26

FOREIGN PATENT DOCUMENTS

FR 2825992 A1 * 12/2002

OTHER PUBLICATIONS

English translation of FR 2,825,992, (2003).*
English Abstract of FP. 2,825,992, Feb. 2009.*

* cited by examiner

*Primary Examiner* — Philip C Tucker
*Assistant Examiner* — Sing P Chan
(74) *Attorney, Agent, or Firm* — Clifford Kraft

(57) ABSTRACT

A modification to the box packaging typically used to store and transport flex trim material rolls or tape that allows the installer to hold and control the package while dispensing the flex trim material or tape directly from the box and placing it directly onto the corner being finished. This is achieved by a combination of perforations and creases which, when pushed in, form a handle on at least one side of the box for grasping the package and a separate hole on the edge of the box through which the flex trim is pulled out of the box and hence dispensed.

6 Claims, 3 Drawing Sheets

FLEX TRIM CONTAINER WITH HANDLES

This application is related to and claims priority from U.S. Provisional Patent application No. 61/000,786 filed Oct. 28, 2007. Application 61/000,786 is hereby incorporated by reference.

BACKGROUND

1. Field of the Invention

The present invention relates generally to the field of drywall corner trim and more particularly to a modification to the box that normal drywall flex trim materials are packaged in for retail distribution and final use.

2. Description of the Prior Art

There are various drywall corner trim materials available in the market used to finish sheet rocked corners. A specific type of these materials are sold in rolls and are called flex trims because they are designed such that they can easily be precreased to any angle (inside or outside) and then placed onto a sheet rocked corner. These rolls sold in boxes so the rolls don't unravel during storage and transport from job site to job site.

These boxes are difficult to get the flex trim material out of for use at the job site. Usually the user opens the box, pulls out a length of material suitable for the sheet rocked corner to be finished, lays the material on the floor of the job site, and cuts it to length. This can be difficult since the flex trim material may tend to roll back up as soon as it's taken out of the box, or it may "flop" around making it difficult to measure & cut to length and finally, place onto the corner which has already been prepared with joint compound.

It would be advantageous to have a package that the user could easily hold with one hand and pull out the drywall trim material placing it directly onto the prepared corner and cut it to length. Currently there is no

SUMMARY OF THE INVENTION

The present invention relates to a modification to the packaging normally used for flex trim materials or tape sold in rolls that enables the user to easily hold the package while pulling the product out of the box through an appropriate slot in the package and placing the product directly onto the corner being finished.

A typical package could be a cardboard box slightly deeper than the depth of a flex-trim roll (or tape roll). The invention perforates the side walls of the cardboard (or other material) in the shape of a slot long enough and wide enough for the user to push at least four fingers through such that a handle is formed when the perforations are pushed on. The slot can be perforated on at least three sides and creased on the fourth such that when the user pushes on the area inside the perforations, the perforations break and the creased side of the slot folds the area pushed on into the box. This flap, which is now inside the box also protects the users fingers against the roll of product rubbing against the users fingers. The shape of the handle patches, while preferably rectangular and parallel to each other can be any shape.

There may be as many as two similar perforations on each of the large sides of the box spaced appropriately so that when the when the area's perforated are punched into the box, creating two cardboard flaps inside the box, they form two open slots. Through one slot the user can put their fingers and through the other slot the user can put their thumb and the slots spaced appropriately that the space between the slots become a handle the user can easily grasp, holding the box.

The slot are positions such they penetrate the box in an area at the open center of the roll of product, the roll having an open inner diameter sufficient in size to accommodate the flaps folding into the box, the users fingers and thumb passing through the slots and grasping the intact box surface between the slots.

DESCRIPTION OF THE FIGURES

The following images give a better understanding of the features of the present invention.

Several illustrations and drawings have been presented to aid in understanding the present invention. The scope of the present invention is not limited to what is shown in the figures.

DESCRIPTION OF THE INVENTION

The present invention relates a modification to the standard packaging for flex trim material used to finish sheet-rocked corners in construction. The package can be modified such that a handle is formed for the purpose of holding the box when dispensing the flex trim material. The modification includes at least one slot created by perforating three lines and creasing a fourth line creating a roughly rectangular shape, or slot. When the area inside the four lines (perforated and creased) is pushed on the perforations break allowing the said area to fold into the box at the creased line. This creates an opening in the side of the box through which the hand can be passed in order to grasp the box. A second slot of the same construction spaced away from the first slot may be added. These two slots then form a handle of sorts by which the box may be grasped and controlled during installation of the flex trim material therein. While rectangular slots are preferred, any shape is within the scope of the present invention included especially rounded slots.

Figure 5:
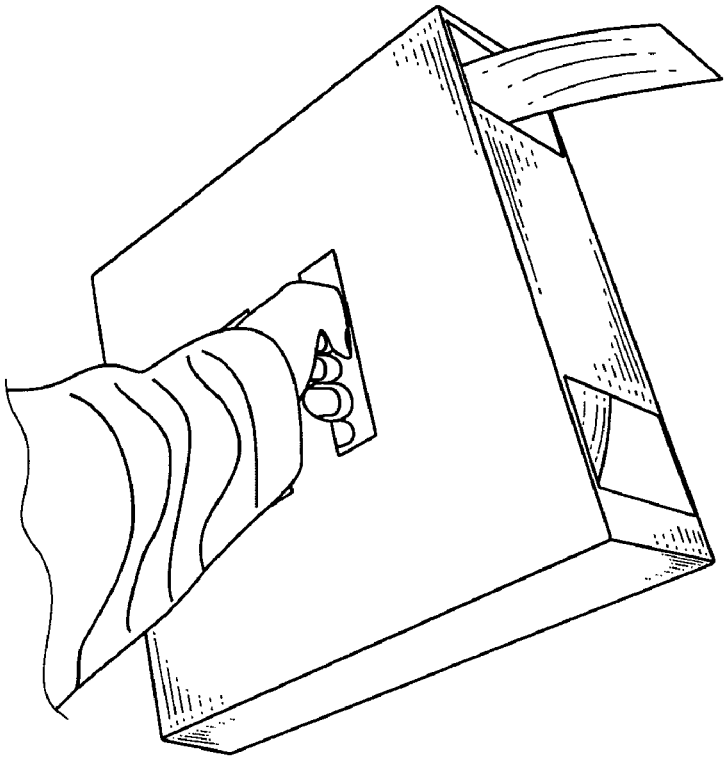
FIG. 5 shows the users hand grasping the box by means of the two slots and the end of the product protruding from the box ready for application the corner.

The box can be made of cardboard or other suitable material with the total shape of a right quadrilateral that has a depth slightly larger than the width of a roll of flex-trim material. The two slots on at least one of the square faces of the box can be rectangular and parallel to each other and spaced to approximately fit a human hand as shown in FIG. 5. As stated, each of these slots can have three perforated sides and a creased side for folding. Both square surfaces of the box can have handle slots if desired. This can then accommodate both right and left handed installers.

Figure 1:
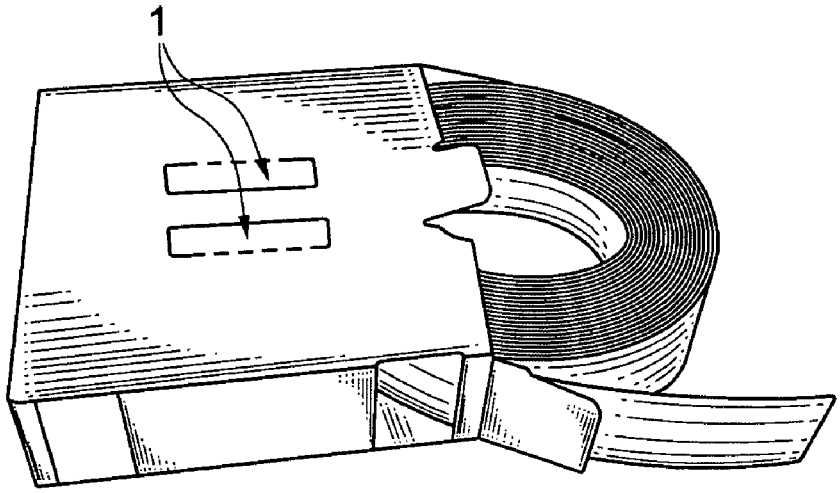
FIG. 1 shows a typical flex trim box and a typical roll of flex trim material being slid into the box. The perforations which will form the slots can also be seen as well as the empty space at the center of the roll which allows the perforations to be pushed into the box and the users hand to pass into the box and grasp the box.

Turning to FIG. 1, a typical box used to package typical flex trim materials (the roll shown) can be seen. Two slots 1 can also be seen on the side of the box. The two slots are formed by a combination of perforated and creased lines in the cardboard material of the box side wall.

Figure 2:
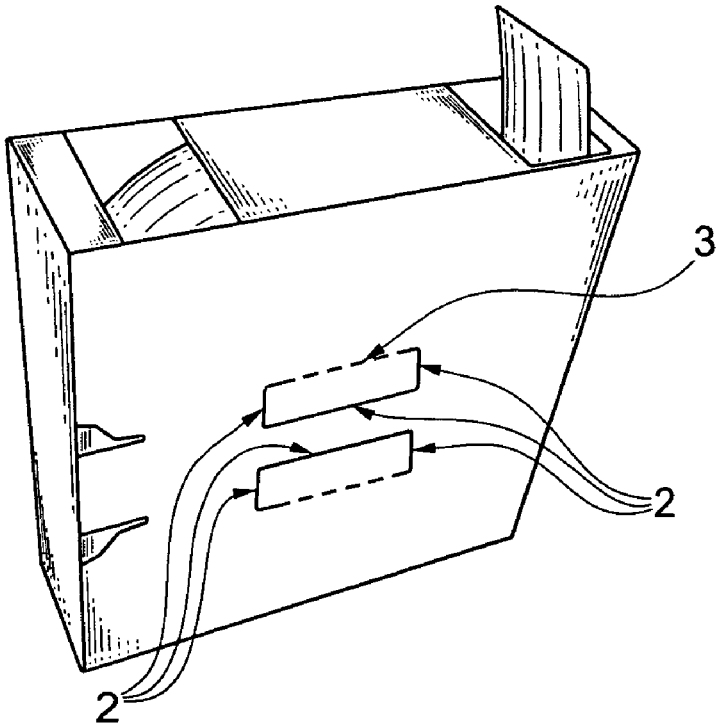
FIG. 2 shows the flex trim box with the roll inside and the box closed. The end of the product can also be seen protruding from an appropriate opening in the box for the purpose of dispensing the product from the box.

FIG. 2 shows three perforations 2 and a crease 3 which form the slot 1 in the side of the box. The linear perforations 2, which form three sides of the slot, are designed such that they will easily break when the adjacent cardboard surface is pushed. The linear crease 3, which forms the fourth side of the slot, is designed such that it will easily fold when the said perforations 2 are broken by pushing on the surface of the box material enclosed by the perforations 2 and the crease 3.

Figure 3:
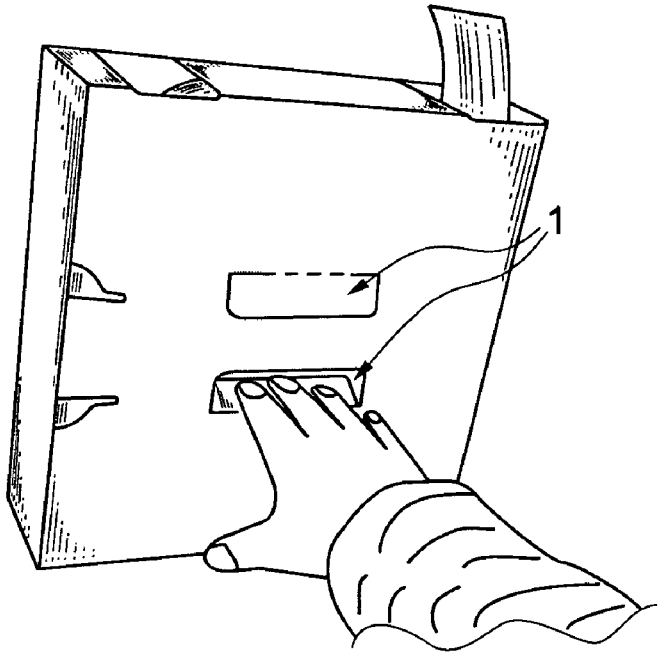
FIG. 3 shows the user pushing the perforated portion of the slot into the box in preparation of grasping the box. The creased side of the slot can be seen folding the flap into the box which will later protect the users hand from the flex trim product as it is dispensed and rolled out.

FIG. 3 shows the slot 1 being pushed open by the user in preparation for use as a handle to hold the box. At least one slot 1 must be present to grasp the box but two slots are preferred.

Figure 4:
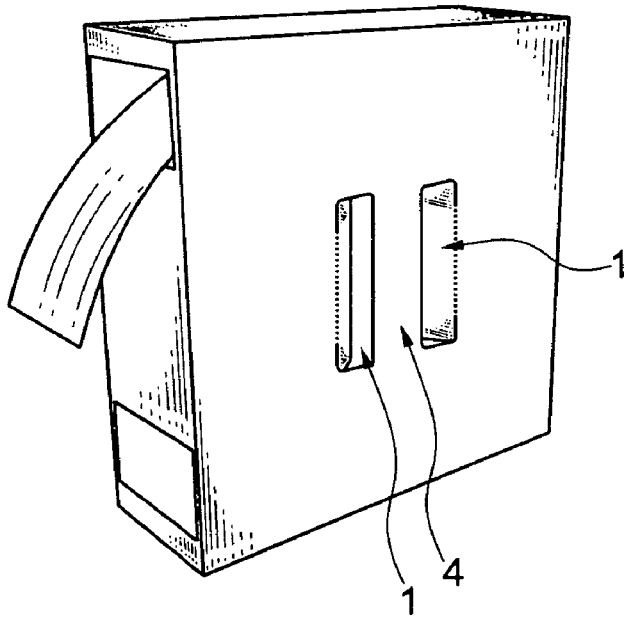
FIG. 4 shows the perforations pushed & folded into the box forming a handle for grasping the box. Again the end of the flex trim material can be seen protruding from the box.

FIG. 4 shows two slots 1 pushed in forming the handle 4 which can now be grasped by hand, holding the box securely for use on the job site FIG. 5 shows a users hand grasping the box using the handle formed by the two slots. One can easily see how the flaps of cardboard protruding into the box function to protect the users hand from the edge of the inside edge or periphery of the flex trim roll when product is being pulled out of the box.

Figure 6:
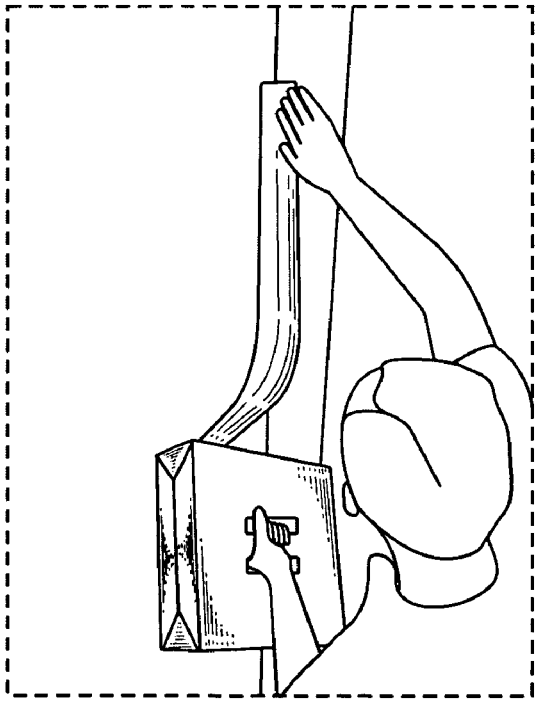
FIG. 6 shows the user dispensing the product directly from the box onto the corner being finished. The box is being held by the previously discussed slots.

FIG. 6 shows a user dispensing flex trim material from the box and placing it directly onto the corner being finished.

During this discussion the flex trim package being discussed has been a box for purposes of describing the invention. It must be noted that this invention may be used with other packaging shapes and types and is not limited to a cardboard box. Also, the dispenser of the present invention may be used for dispensing any kind of tape-like material including drywall tape as well as flex-trim material. It should also be noted that the dispenser does not have to be square or rectangular, but could be round or some other shape; a square box is preferred since flex-trim and tape rolls are round and fit nicely in the box. The handle patches do not have to be rectangular, but could be curved or any other shape that can be adapted to the human hand.

Several descriptions and illustrations have been presented to aid in understanding the present invention. One with skill in the art will realize that numerous changes and variations can be made without departing from the spirit of the invention. Each of these changes and variations is within the scope of the present invention.

I claim:

1. A method of dispensing flex-trim material or drywall tape comprising:

placing a roll of drywall flex-trim material or tape in a box of depth slightly larger than a roll of drywall trim's width;

feeding a leader of said flex-trim material or tape through a hole in said box's periphery;

punching out a pair of handle patches on at least one side of said box to form a handle, wherein said handle patches have, before being punched out, a partly perforated edge and a partly creased edge, and wherein said handle patches are disposed on said side of the box so that the partly perforated edges face each other, and when punched out, form a central handle with the handle patches forming a pair of flaps hinged on the partly creased edge away from said central handle;

dispensing said flex-trim material or tape by holding said box by said central handle and feeding said flex-trim material or tape onto a wall or ceiling through said hole, wherein said flaps inside the box protect a user's fingers from rubbing against said roll of drywall flex-trim or tape.

2. The method of claim 1 wherein said box is cardboard.

3. The method of claim 1 wherein said handle patches are generally rectangular.

4. The method of claim 1 wherein said handle patches are generally parallel.

5. The method of claim 1 wherein both sides of said box contain handle patches.

6. The method of claim 1 wherein an end of said box functions as a lid.

* * * * *